US007275520B2

(12) United States Patent
Boecking

(10) Patent No.: US 7,275,520 B2
(45) Date of Patent: Oct. 2, 2007

(54) FUEL INJECTION DEVICE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/565,559

(22) PCT Filed: Jun. 9, 2004

(86) PCT No.: PCT/DE2004/001197

§ 371 (c)(1),
(2), (4) Date: Jan. 23, 2006

(87) PCT Pub. No.: WO2005/010340

PCT Pub. Date: Feb. 3, 2005

(65) Prior Publication Data

US 2006/0219805 A1 Oct. 5, 2006

(30) Foreign Application Priority Data

Jul. 24, 2003 (DE) ..... 103 33 697

(51) Int. Cl.
*F02M 37/04* (2006.01)

(52) U.S. Cl. ..... 123/446; 123/467

(58) Field of Classification Search ..... 123/467, 123/446, 500, 501, 506, 502, 514
See application file for complete search history.

(56) References Cited

U.S. PATENT DOCUMENTS 6,067,955 A * 5/2000 Boecking ..... 123/299
6,422,211 B1 * 7/2002 Boecking ..... 123/501
6,484,697 B2 * 11/2002 Boecking ..... 123/467

(Continued)

FOREIGN PATENT DOCUMENTS

DE 197 32 802 A1 2/1999

(Continued)

*Primary Examiner*—Carl S. Miller
(74) *Attorney, Agent, or Firm*—Ronald E. Greigg

(57) ABSTRACT

A fuel injection device has an injection valve, a line that supplies highly pressurized fuel to the injection valve during operation, a control valve that controls the pressure in a control chamber of the injection valve, which chamber is connected to the line, and whose moving valve element is actuatable by an actuator via a hydraulic coupler having two pistons cooperating with a coupler volume of the coupler, the seat of the moving valve element having an inner cross-sectional surface area f3 and a conduit for filling the coupler volume with pressurized fuel via guidance gaps of the pistons. The pistons are situated one inside the other in parallel fashion; a booster chamber is situated at the ends of the pistons oriented away from the actuator; inside the outer piston, there is a filling chamber that is connected to the above-mentioned line; one of the pistons, which has a piston surface area f4, is mechanically coupled to the actuator by means of a rod that has a cross-sectional surface area f5; the other piston, which has a piston area f2, actuates the control valve by means of a rod that has a cross-sectional area f1 that is smaller than f2; the direction of the closing movement of the moving valve element coincides with the direction of fuel flowing out of the control chamber so that the control valve is at least partially force-balanced due to the pressure acting on the other piston in the filling chamber.

1 Claim, 1 Drawing Sheet

U.S. PATENT DOCUMENTS

| | | | | |
|---|---|---|---|---|
| 6,725,841 | B1 * | 4/2004 | Boecking | 123/467 |
| 6,752,324 | B1 | 6/2004 | Mattes | |
| 6,877,483 | B2 * | 4/2005 | Askew | 123/467 |
| 6,915,785 | B2 * | 7/2005 | Eisenmenger et al. | 123/446 |
| 6,994,272 | B2 * | 2/2006 | Kurrle et al. | 239/96 |
| 2002/0179730 | A1 | 12/2002 | Boecking | |
| 2003/0062026 | A1 | 4/2003 | Boecking | |

FOREIGN PATENT DOCUMENTS

| | | | |
|---|---|---|---|
| DE | 100 44 120 | A1 | 4/2002 |
| DE | 101 01 802 | A1 | 7/2002 |
| DE | 101 18 054 | A1 | 10/2002 |
| JP | 11-193763 | | 7/1999 |
| WO | WO 01/31192 | A1 | 5/2001 |

* cited by examiner

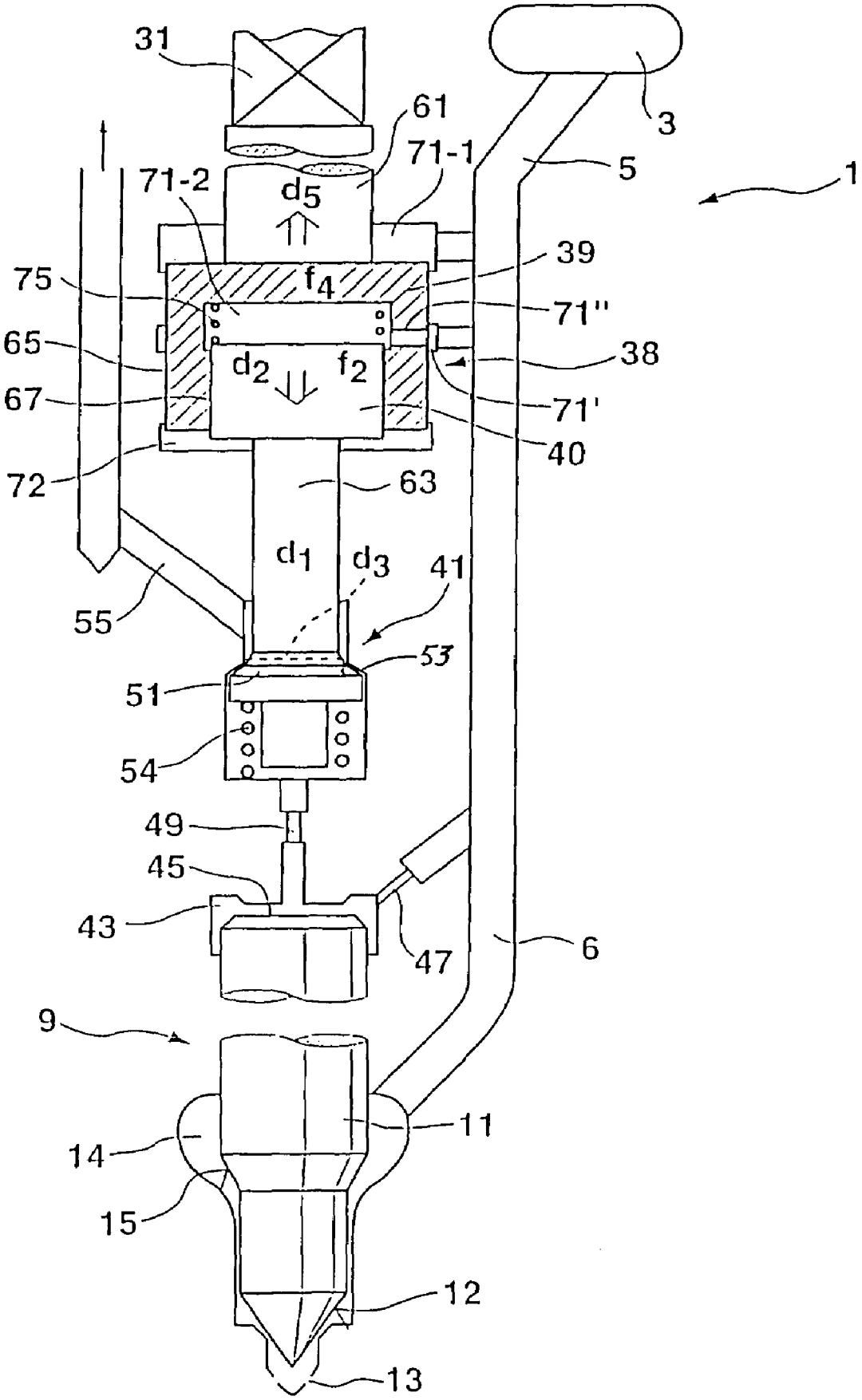
31
61
71-1
71-2
d5
3
5
1
39
75
f4
71''
65
38
d2
f2
67
71'
40
72
63
d1
d3
41
55
53
51
54
49
45
43
47
6
9
11
14
15
12
13

FUEL INJECTION DEVICE

CROSS-REFERENCE TO RELATED APPLICATIONS

This application is a 35 USC 371 application of PCT/DE 2004/001197 filed on Jun. 9, 2004.

BACKGROUND OF THE INVENTION

1. Field of the Invention

The invention is directed to an improved fuel injection device for use in an internal combustion engine.

2. Description of the Prior Art

A CR injector (CR=common rail) with a piezoelectric actuator and boosting by means of a hydraulic coupler is known. The known prior art also includes integrated couplers with pistons contained coaxially one inside the other. The known device uses a valve that opens outward as a control valve. This valve can only be embodied with a relatively small diameter since otherwise, the forces on the valve become too great and it cannot be actuated by a piezoelectric actuator.

SUMMARY AND ADVANTAGES OF THE INVENTION

The fuel injection device for internal combustion engines according to the present invention has the advantage over the prior art of producing a CR injector with a piezoelectric actuator in which it is possible for a larger valve cross-section to be used. This permits the opening and closing of the injection valve to occur more rapidly. The integrated coupler permits a short structural length of the device. The coupler is assisted by CR pressure.

BRIEF DESCRIPTION OF THE DRAWINGS

An exemplary embodiment of the fuel injection device according to the present invention is described more fully herein below, in conjunction with the sole drawing figure which shows the essential components of a fuel injection device with an injection valve, a control valve, and a hydraulic coupler.

DESCRIPTION OF THE PREFERRED EMBODIMENT

The fuel injection device 1 according to the present invention is supplied with highly pressurized fuel from a pressure accumulator (common rail) 3 via a high-pressure line 5 from which fuel travels via an injection line 6 to an injection valve 9. An internal combustion engine normally has a number of such infection valves and for the sake of simplicity, only one of these is shown. The injection valve 9 has a valve needle (valve piston, nozzle needle) 11, whose conical valve sealing surface 12, in its closed position, closes injection openings 13 through which fuel is to be injected into the interior of the combustion chamber of an internal combustion engine. The fuel travels into the region of the nozzle needle via an annular nozzle chamber 14 from which it is able to exert a pressure on the nozzle needle in the opening direction by means of a control surface 15 embodied in the form of a pressure shoulder. If the above-mentioned pressure exerts a force on the valve needle in the opening direction that overcomes forces counteracting this opening action, then the valve opens.

An actuator 31 controls the opening and closing of the injection openings. Depending on how it is triggered, this actuator produces a deflection at a mechanical output and a force for actuating other elements. In the example, it is an electrically triggered actuator. In the example, it is an actuator that has a piezoelectric element, namely a piezoelectric actuator. Depending on an electrical triggering, the actuator assumes an elongated configuration or a shortened configuration in the vertical direction in the drawing and consequently in its longitudinal direction. In the example, an actuator is provided whose design is such that when supplied with current (connection to a direct current supply), it assumes an elongated configuration and when without current, it assumes a shortened configuration. The actuator constitutes a capacitive load and does not absorb any power dissipation when continuously supplied with current. It can be advantageous or necessary to preload the piezoelectric actuator by means of a tensioning device, e.g. a spring, so that pressure is continuously exerted on piezoelectric elements contained in the actuator. This is known to those skilled in the art and therefore will not be discussed below. While the upper end of the piezoelectric actuator is anchored in the injection device in a manner not shown in the drawing, the force and movement of the lower end of the piezoelectric actuator are used to open and close the injection openings. For coupling purposes, a hydraulic coupler 38 is provided that has one piston 39 coupled to the piezoelectric actuator and another piston 40. In the current intended use, it is necessary, generally by means of the coupler, for there to be an increase in the travel distance of the first piston 40 in comparison to the travel distance of the second piston 39 (through appropriate selection of the hydraulically effective piston surface areas). The design and function of the hydraulic coupler will be described further below.

If the piston 40 of the hydraulic coupler not directly connected to the piezoelectric actuator opens a control valve 41 (or exhaust valve), then a pressure drop occurs in a fuel-filled control chamber 43 into which the upper end section of the nozzle needle protrudes. The control chamber 43 is filled with pressurized fuel via an inlet throttle 47 and when the control valve 41 is open, fuel flows out of the control chamber 43 via an outlet throttle 49. The outward flow of fuel is assisted by forces that act on the nozzle needle 11 in the direction of its open position. When the control valve 41 is closed, a moving valve element 51 rests against a valve seat 53 in a sealed fashion and is mechanically coupled to the piston 40. The control quantity that flows out of the control chamber when the valve element 51 is open is drained away via a leakage conduit 55. When the valve element 51 is closed, rail pressure (=pressure in the line 5) acts on it from the control chamber; the pressure acts on the surface area with the diameter d3.

The pistons 39 and 40 in the example are situated parallel to each other, one inside the other and, in an advantageous manner from a production standpoint, are situated coaxially one inside the other (integrated coupler). The manner in which they are coupled to each other will be explained below. The piston 39 has an arrow drawn in it, which indicates the movement of this piston when the actuator moves in the downward direction in the drawing. The piston 40 has an arrow drawn in it, which indicates the movement of this piston when the piston 39 executes the movement indicated by its arrow. By comparing the arrow of the piston 40 with the direction in which the movable valve element of the valve to be actuated by the hydraulic converter 38 must be moved in order for the opening or closing to occur, it is immediately clear from the drawing whether the direction of the above-mentioned arrows shown in the drawing corresponds to an opening event or a closing event of the above-mentioned valve.

The moving valve element 51 is essentially conical with a cylindrical extension. In particular, it rests with its conical part against the valve seat 53 when closed. A compression spring 54 guided by the cylindrical extension preloads the valve element 51 toward its valve seat 53. In its closed position, it has been moved "outward ", namely in the direction away from the high pressure in the control chamber 43 toward a region of lower pressure (leakage pressure). The exhaust valve in this case is thus embodied as a valve that opens outward. The side of the valve element 51 oriented toward the valve seat 53 is rigidly connected to an actuating part that is connected to the hydraulic coupler. The connection with the piston is advantageously tension-resistant for a particularly rapid closing.

The actuator 31 is connected to the piston 39 by means of a rod 61 with a diameter d5. The piston 40 is connected by means of a rod 63 with a diameter d1 to the moving valve element 51 that it is to actuate. The outer piston 39 has an annular piston surface with a surface area f4 and the inner piston 40 has a diameter d2 (and therefore a surface area of $0.25\times\pi\times d2^2$). The inner diameter of the valve seat 53 at the point where the moving valve element rests against it is d3.

Guidance gaps 65 and 67 that guide the piston in its sliding motion and through which a coupler volume is filled with fuel are provided in the region of the cylindrical outer surface of the outer piston (facing a housing that is not shown) and in the region of the reciprocal sliding guidance of the two pistons.

The surface areas f1 through f3 and f5, which correspond to the above-mentioned diameters d1 through d3 and d5 (for circular cross sections), and the above-mentioned surface area f4 are decisive for the function. Circular cross sections are in fact useful from a manufacturing standpoint, but the present invention is not limited to them.

The end regions of the pistons 39 and 40 oriented away from the actuator 31 protrude into a shared booster chamber 72. The other end region of the piston 39 protrudes into a filling chamber 71-1 that is connected to the line 5. The other end region of the inner piston 40 protrudes into a filling chamber 71-2 that is filled with CR pressure by means of an annular groove 71' via a conduit 71" in the piston 39. The booster chamber 72 is filled via the guidance gaps 65 and 67. The rod 63 extends through the booster chamber 72. The rod 61 extends through the filling chamber 71-1. The pistons 39 and 40 move in opposite directions and, due to the desired boosting of the travel distance from the actuator to the control valve, travel at different speeds.

When the injection valve 9 is closed, the actuator 31 (piezoelectric actuator) is supplied with current and elongated. In order to open the control valve 41, the electrical current to the actuator 31 is switched off and the actuator becomes shorter. This causes the piston 39 (first booster piston) to move upward in the drawing, assisted by the spring 75. In the idle state, CR pressure (=pressure in the pressure accumulator or common rail) prevails as the system pressure in the booster chamber 72. The upward movement of the piston 39 reduces the pressure in the booster chamber 72. This pressure drop moves the piston 40 (second booster piston) downward and, through a movement of the valve element 51 in the same direction, opens the control valve 41, which is an outward-opening valve. In order for the valve element 51 to close rapidly, it is connected to the rod 63 and consequently to the piston 40. The pressure in the booster chamber 72 closes the valve element 51 with a force proportional to ($d2^2-d1^2$). The filling chamber 71-2 is filled with CR pressure; this allows the seat diameter d3 of the valve element 51 to be selected as very large since the piston 40 largely compensates for this area with its back end situated in the filling chamber 71-2. The present invention thus produces an advantageous outwardly opening servo injector with CR pressure assistance for a very rapid opening and closing of the injection valve. The coupler provides for a short structural length.

An important characteristic of the invention lies in the fact that the back side of the piston 40 directly connected to the control valve (by contrast with the side in the booster chamber) is subjected to rail pressure, which assists the actuation of the control valve and counteracts the pressure from the control chamber 43 that acts on the valve element 51 in the closed state.

Because of the rail pressure in the filling chamber 71-2, $d_3$ is largely force-balanced. In comparison to the prior art, therefore, there is a greater surplus of force supplied by the actuator available for accelerating the mass of the moving valve element. The invention consequently achieves a variant with a control valve that is partially balanced (=partially balanced in terms of the force), the valve being one that opens outward. The force that the actuator must generate to close the valve is therefore less than in the known valve. Instead of this, in one embodiment form, a valve 51 is provided with a diameter d3 that is larger than in the known one, thus permitting a more rapid opening and closing of the injection valve because the flow increase and decrease is greater in it than in the known, smaller outward-opening valve.

A compression spring 75 in the filling chamber 71-2 pushes the pistons apart from each other and assures good contact of the coupler against the actuator 31 and, when the valve is closed, of the valve element 51 against the valve seat 53.

The present invention also includes embodiments in which the highly pressurized fuel is supplied not by a high-pressure accumulator, but by a pump associated with the injection valve (unit injector) that also supplies the filling chamber.

The foregoing relates to a preferred exemplary embodiment of the invention, it being understood that other variants and embodiments thereof are possible within the spirit and scope of the invention, the latter being defined by the appended claims.

The invention claimed is:

1. In a fuel injection device, having an injection valve, having a line that supplies highly pressurized fuel to the injection valve during operation, and having a control valve that controls the pressure in a control chamber of the injection valve, which chamber is connected to the above-mentioned line, and whose moving valve element is actuatable by an actuator via a hydraulic coupler that has two pistons that cooperate with a coupler volume of the coupler, the seat of the moving valve element having an inner cross-sectional surface area f3 and with means for filling the coupler volume with pressurized fuel via guidance gaps of the pistons, the improvement wherein the pistons are situated one inside the other in parallel fashion; a booster chamber situated at the ends of the pistons oriented away from the actuator; a filling chamber inside the outer piston, the filling chamber being connected to said line by means of an annular groove via in a housing guiding said outer piston and a conduit in the outer piston; one of the pistons having a piston surface area f4 being mechanically coupled to the actuator by means of a rod that has a cross-sectional surface area f5; the other piston, which has a piston area f2, actuating the control valve by means of a rod that has a cross-sectional area f1 that is smaller than f2; the direction of the closing movement of the moving valve element coinciding with the direction of fuel flowing out of the control chamber so that the control valve is at least partially force-balanced due to the pressure acting on the other piston in the filling chamber.

* * * * *